US007467422B2

(12) United States Patent
Bugarin

(10) Patent No.: US 7,467,422 B2
(45) Date of Patent: Dec. 23, 2008

(54) HOODED SCARF

(76) Inventor: Liza Bugarin, 50 Bennington, Irvine, CA (US) 92620

( * ) Notice: Subject to any disclaimer, the term of this patent is extended or adjusted under 35 U.S.C. 154(b) by 149 days.

(21) Appl. No.: 10/999,870

(22) Filed: Nov. 30, 2004

(65) Prior Publication Data

US 2006/0143796 A1 Jul. 6, 2006

(51) Int. Cl.
*A42B 1/04* (2006.01)

(52) U.S. Cl. ..... 2/202; 2/203

(58) Field of Classification Search ..... 2/410, 2/4, 9, 468, 48, 50, 91, 92, 84, 202, 203–208, 2/247, 916, 171, 172, 209.13, 174
See application file for complete search history.

(56) References Cited

U.S. PATENT DOCUMENTS

| | | | | | |
|---|---|---|---|---|---|
| 1,075,247 | A * | 10/1913 | Fiori | 2/203 |
| 1,097,530 | A * | 5/1914 | Cabelinsky | 2/84 |
| 3,698,014 | A * | 10/1972 | Little et al. | 2/84 |
| 4,573,217 | A * | 3/1986 | Reed | 2/7 |
| 5,115,517 | A * | 5/1992 | Ferguson et al. | 2/203 |
| 5,251,336 | A * | 10/1993 | Nevins | 2/202 |
| 5,575,009 | A * | 11/1996 | Ryvin | 2/173 |
| 5,704,068 | A * | 1/1998 | Martin | 2/173 |
| 5,713,077 | A * | 2/1998 | Humbrecht | 2/173 |
| 5,802,618 | A * | 9/1998 | Mustata | 2/207 |
| 5,845,340 | A * | 12/1998 | Frislie | 2/202 |
| 5,960,478 | A * | 10/1999 | Sivret et al. | 2/202 |
| 6,023,787 | A * | 2/2000 | French et al. | 2/202 |
| 6,226,799 | B1 * | 5/2001 | Lane | 2/207 |
| 6,425,138 | B1 * | 7/2002 | Johnson | 2/202 |
| 6,532,596 | B1 * | 3/2003 | Fosmo | 2/49.1 |
| 6,665,878 | B1 * | 12/2003 | Way | 2/84 |
| 6,789,266 | B1 * | 9/2004 | Mills et al. | 2/172 |
| 7,028,345 | B2 * | 4/2006 | Waldman | 2/468 |
| 2003/0126672 | A1 * | 7/2003 | Giggleman et al. | 2/202 |
| 2004/0187186 | A1 * | 9/2004 | Boezi | 2/84 |
| 2005/0028242 | A1 * | 2/2005 | Thomas et al. | 2/84 |
| 2006/0085881 | A1 * | 4/2006 | Gellis et al. | 2/9 |

* cited by examiner

*Primary Examiner*—Alissa L Hoey
(74) *Attorney, Agent, or Firm*—Maria Erlinda Co Sarno

(57) ABSTRACT

A one-piece hooded scarf, comprising a tubular neckpiece having a top end and a bottom peripheral end, the neckpiece having openings or channels for breathing produced when made from a material elastically deformable in two axes; and, a hood connected at the bottom peripheral end of the neckpiece to leave the top end of the neckpiece free thereby allowing introduction of the neckpiece over the head of a wearer. The hood can be permanently connected to the neckpiece or detachable. The material of the hood can be the same or different from the neckpiece. The hooded scarf can have a tail or a chestpiece which can incorporate an open or secret pocket. The neckpiece can be of variable height to enable it to cover or uncover a lower face area, ear and nose of a wearer.

17 Claims, 17 Drawing Sheets

HOODED SCARF

This invention relates to a one piece hooded scarf suitable for cold and warm weather having a tubular or turtleneck portion, hereinafter referred to simply as neckpiece, covering the neck and a hood is connected at the base of the neckpiece to provide head protection. One end of the neckpiece is expandable to cover the lower face area and nose.

BACKGROUND

Scarves are usually made of a long rectangular piece of material that wraps around a wearer's neck. These are used to protect the neck from adverse weather conditions or for decorative purposes. Often, these scarves fall off as a result of normal head and neck motion. Consequently, fasteners or pins are used to keep the scarf wrapped around the neck or the ends are tied together. Tying both ends of the scarf used for cold weather usually result in a bulky knot or sometimes, unattractive knot, due to the thick material from which it is made. Consequently, this knot often gets into the way of the wearer. Additionally, whether it is made from a thick material or not, the amount of tension on the knot changes as the wearer moves around causing, oftentimes, the scarf to loosen and thereby lose its ability to adequately protect the neck. This situation is worsened when the wearer is a child. Children usually are more movable than the adults, they also undo the fasteners, get pricked when attempting to remove the pin, or lose the scarf. They get into their way while playing, running, jumping, etc.

The proposed hooded scarf is a one piece pull over combination of a scarf and hood which covers or protects both the head and the neck, with the scarf or neckpiece adjustable, as desired to protect a portion of the face under the eyes as well as the chest area. To cover a portion of the face, the length or in this case synonymous to the height of the neckpiece because it is oriented upwards, can be varied. It can be of a length/height just enough to cover the neck or it can be lengthened to expand, if desired, to cover the lower face area and nose, consequently, doing away with the need for ear muffs to protect the ears, and mask to protect the nose and mouth from exposure to inclement weather or dust. U.S. Pat. No. 5,802,618 proposes a scarf comprising a neckpiece and a bib or chestpiece. To close the neckpiece, fasteners are usually placed on opposite ends of the lateral edges of the neckpiece. In this scarf, once the fasteners lose or reduces their gripping ability with usage and time such as in a hook and loop fastener, or the fastener falls off like a button or hook, the scarf, likewise, loses its ability to protect the neck. Additionally, there is no proposal to connect this scarf to a hood to protect the head, thereby not providing full protection. U.S. Pat. No. 6,272,690 discloses a head covering which is connected to a mask member and in an alternate design, a scarf extends downwardly from the head member. The head covering does not have the flexibility to have the nose and lower face uncovered at will. U.S. Pat. No. 6,023,787 refers to a hood with a faceguard. The portion covering the neck extends from the hood and includes a faceguard which hangs down from the bottom of the neck portion. To use the faceguard, the neck portion is pulled up into the hood so that the exterior neck portion is turned outside in to align the faceguard with the wearer's face. This hood entails manipulation of the neck portion to cover the nose and mouth which can be cumbersome and time taking, especially for children, for an off and on situation, for example, as one enters or leave a building. Also, when the face guard is used, as the faceguard is turned outside in to cover the face, the covering of the front portion of the neck will necessarily be pulled up causing inadequacy in covering the neck. Another patent, U.S. Pat. No. 5,765,230 proposes a single multifunction head apparel. To provide covering a face mask, similar to '787, the neck opening needs to be involuted to take a portion of the neck covering to cover the face. Like '787, this manipulation is cumbersome and may be additionally difficult especially for children to do which may discourage them to do it at all even if needed. Also, this will necessitate a dual layer covering the mid portion of the face which would impede free breathing, thereby necessitating a gasket for escapement of user's breath. Further, for both '787 and '230, once the neckpiece is involuted to cover the face, it will not be as easy to cover and uncover the head with the hood unless the neck bottom portion is of such length so as to leave a sizeable neck portion still lodging on the shoulders when the neck opening is involuted to cover the face. The latter requires more materials to be used and will be bulkier than the claimed invention It is therefore an object of this invention to provide a one piece hooded scarf that will not fall off even with extensive head and neck motion.

It is also an object of this invention to provide an ear, nose and lower face covering that can be easily put on and off at will.

It is a further object of this invention to provide a one piece pullover hooded scarf without the need of fasteners.

This and other objects of the present invention will become apparent upon further review of the specification and drawing.

SUMMARY OF THE INVENTION

This invention relates to a one-piece hooded scarf, comprising a tubular neckpiece having a top end and a bottom peripheral end, the neckpiece having openings or channels for breathing produced when made from a material elastically deformable in two axes; and, a hood connected at the bottom peripheral end of the neckpiece to leave the top end of the neckpiece free thereby allowing free introduction of the neckpiece by pulling the tubular neckpiece over the head of a wearer. The openings and channels on the neckpiece are automatically produced when the material used to make the neckpiece is knitted, crocheted or loosely woven. The materials suitable for making the hooded scarf can be synthetic or natural. The material and make up for the hood can be the same or different from the neckpiece since there is no strict requirement for openings or channels on the hood. The hooded scarf can have a tail of different geometric shape and size. The tail can have various designs printed or sewn on its surface. Instead of a tail, the hooded scarf can have a chestpiece for covering the chest and back. Both tail and chestpiece can incorporate a closable or open pocket. A closable secret pocket is especially beneficial for keeping money and valuables because the tail and the chestpiece can be tucked inside the clothing. The neckpiece is of variable height, it can be enough to cover or uncover a lower face area, ear and nose of a wearer or just enough for example, to cover the neck of a wearer. Instead of a whole tubular piece, the neckpiece can also be closable for example by a zipper to be able to convert the neckpiece into a collar. The hood is detachable from or permanently connected to the neckpiece.

Other embodiments of the present invention will become readily apparent to those skilled in the art from the following detailed description, wherein it shows and describes only certain embodiments of the invention by way of illustration. As will be realized, the invention is capable of other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF THE DRAWING

Aspects of the present invention are illustrated by way of example, and not by way of limitation, in the accompanying drawings, wherein.

DETAILED DESCRIPTION

The detailed description represented herein is not intended to represent the only way or the only embodiment in which the claimed invention may be practiced. The description herein is provided merely as an example or examples or illustrations of the claimed invention and should not be construed as the only way or as preferred or advantageous over other embodiments or means of practicing the invention. The detailed description includes specific details to provide a thorough understanding of the claimed invention and it is apparent to those skilled in the art that the claimed invention may be practiced without these specific details. In some instances, well known structures and devices are shown in block diagrams or drawn with broken lines in order to avoid obscuring the main concepts of the invention.

Figure 1A:
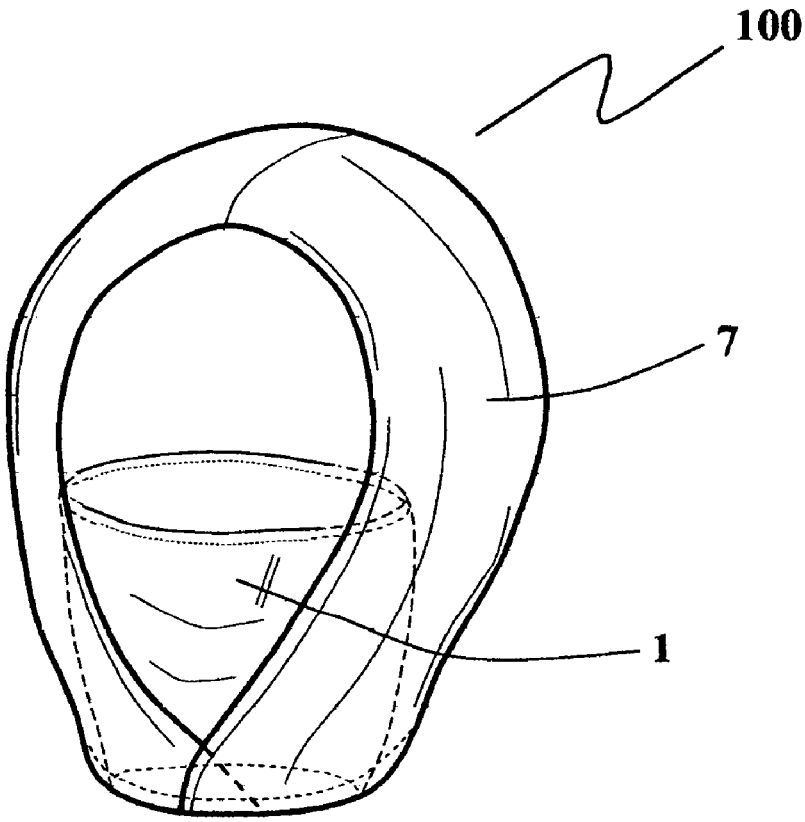
FIG. 1A is a perspective view of the hooded scarf.
Figure 1B:
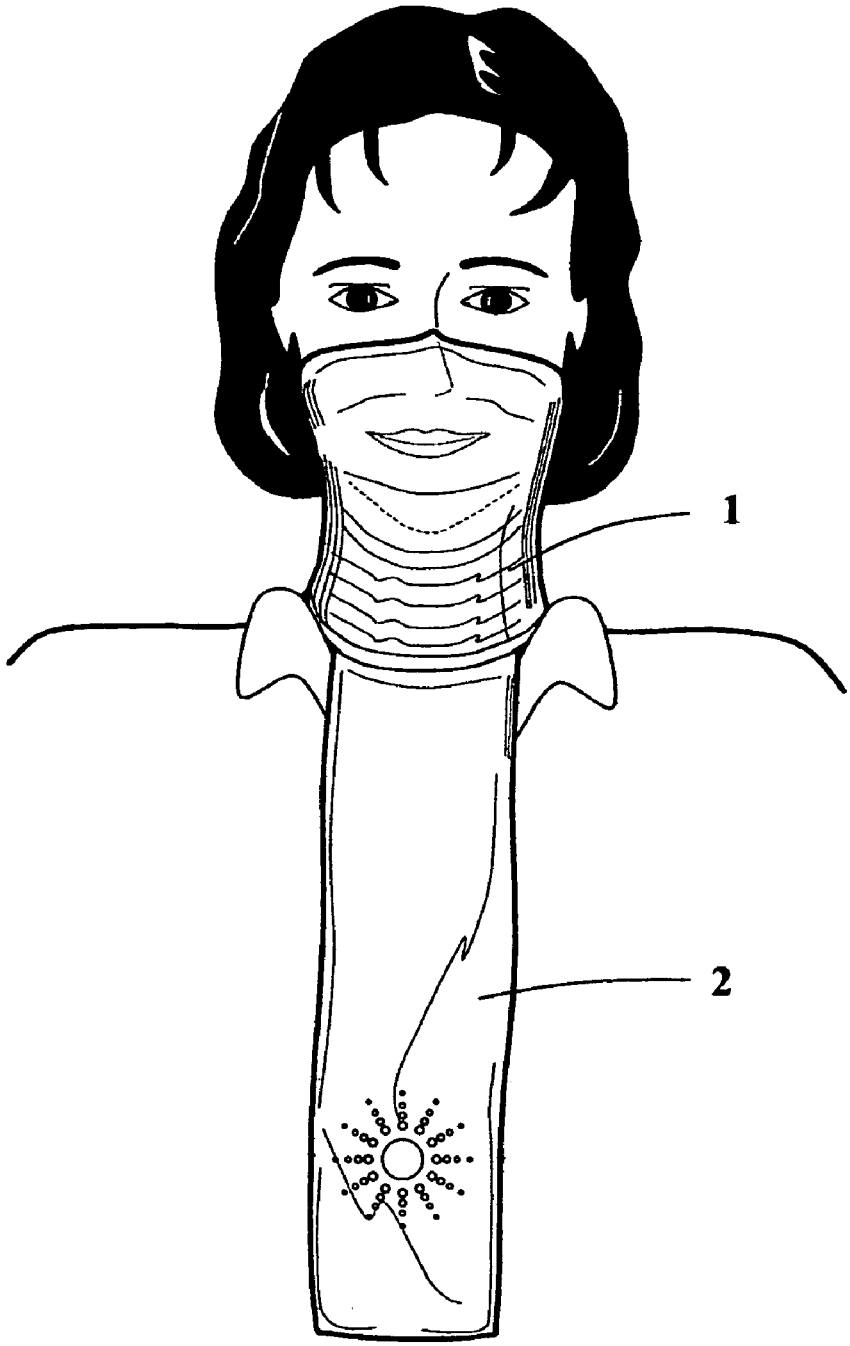
FIG. 1B is a front view of the neckpiece without a hood but includes a tail.
Figure 1C:
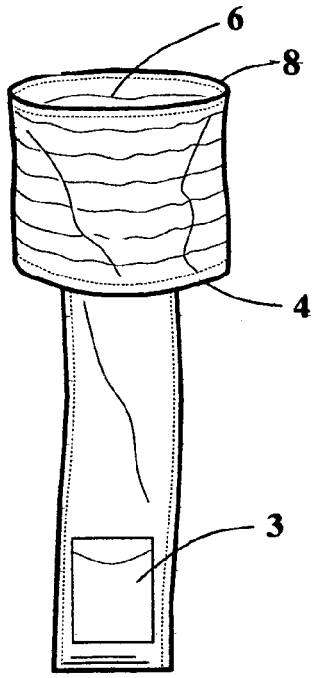
FIG. 1C is a back view of the neckpiece with a flat rectangular tail showing the pocket.
Figure 1D:
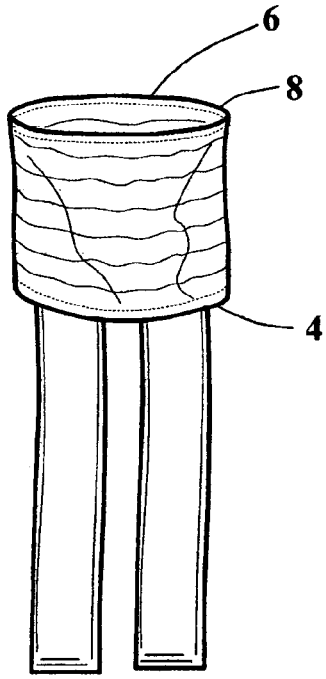
FIG. 1D is a perspective view of the neckpiece with two flat rectangular tails.
Figure 1E:
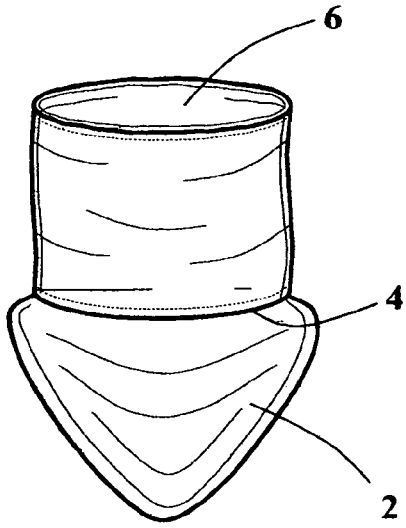
FIG. 1E is a perspective view of the neckpiece with a flat triangular tail.
Figure 6:
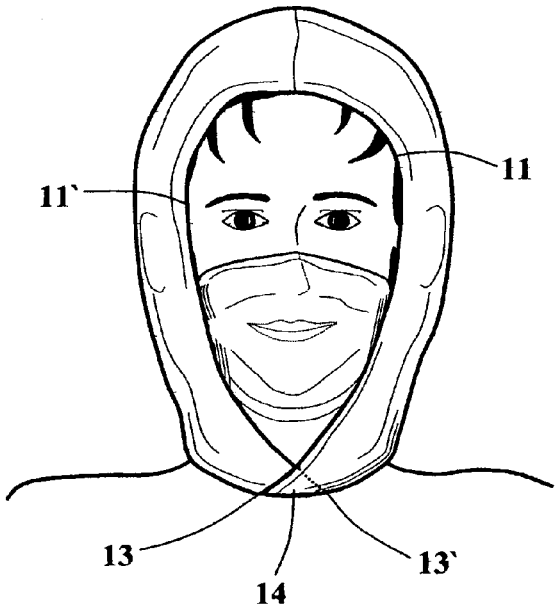
FIG. 6 is a front view of the hooded scarf showing the overlap of the tip ends of the hood.

FIG. 1A shows the perspective view of the hooded scarf 100 while FIG. 1B shows the scarf without a hood. The hooded scarf comprises a hood, a tubular neckpiece 1 and at least one longitudinally directed tail 2 extending from a side or front of the bottom peripheral end 4 portion of the neckpiece as shown in FIGS. 1B. 1C, 1D and 4. The tail can have different geometric shapes. The shape, size and length of the tail 2 depend upon the anticipated usage. A tail of at least approximately twice the length of the neckpiece when the tail piece is fully extended is recommended as shown in FIGS. 1B. 1C, 1D, 3 and 3A. For example, it may be a plain long flat rectangle as shown in FIG. 1C. This tail is usually positioned to cover the chest of the wearer. However, since the neckpiece 1 from where the tail extends from is one piece and tubular, not connected by fasteners, the tail can be positioned anywhere by merely rotating the neckpiece and locating the tail at any desired location. The tail 2, aside from protecting the chest area, can also be used for other purposes such as decorative purposes in the same manner as scarves are used with dresses, shirts or men and women suits. It is also a good place to print or embroider names, initials, logos, etc. for example, the name of a sport team or school which are herein collectively referred to as designs. It can also serve to keep the tubular part of the scarf, the neckpiece, from turning by tucking the tail inside the shirt, pants or skirt. Additionally, a secret or exposed pocket 3 may be sewn or incorporated into the tail to provide a means for keeping small items, money or cards as shown in FIG. 1C. For keeping valuables, this pocket is recommended to be closable, for example by a zipper. If the tail has two layers, it would be best to put the secret pocket in between the layers. For the tail with pockets, the knit or weave is recommended to be tighter than the neckpiece to keep the tail and the pocket from sagging with the weight of the objects placed inside the pocket. The design and location of the pocket can be variable. The pocket illustrated in FIG. 1C is merely used to show one way of attaching the pocket. For coordination, this can have the same knitted, crocheted or woven material as the hood. The neckpiece may also extend to or connect with a second tail as shown in FIG. 1D. The second tail may be used to cover the wearer's back while the first tail covers the front or chest. The position of the first and second tail is at the discretion of the wearer. The second tail may be positioned opposite or side by side with the first tail and used to tie a bow or a necktie, for example. For bows, instead of having two tails extending or expanding from the neckpiece, it may be better to get a long rectangular scarf shaped like a stole and connect a mid peripheral end portion of the scarf to a mid portion of the bottom peripheral end 4 of the neckpiece. The tail may be triangular in shape as shown in FIG. 1E. Other shapes and design for the tails are only left to one's imagination. The hooded scarf may be made without a tail, with the hood attaching to the neckpiece as shown in FIGS. 1A and 6.

Figure 2:
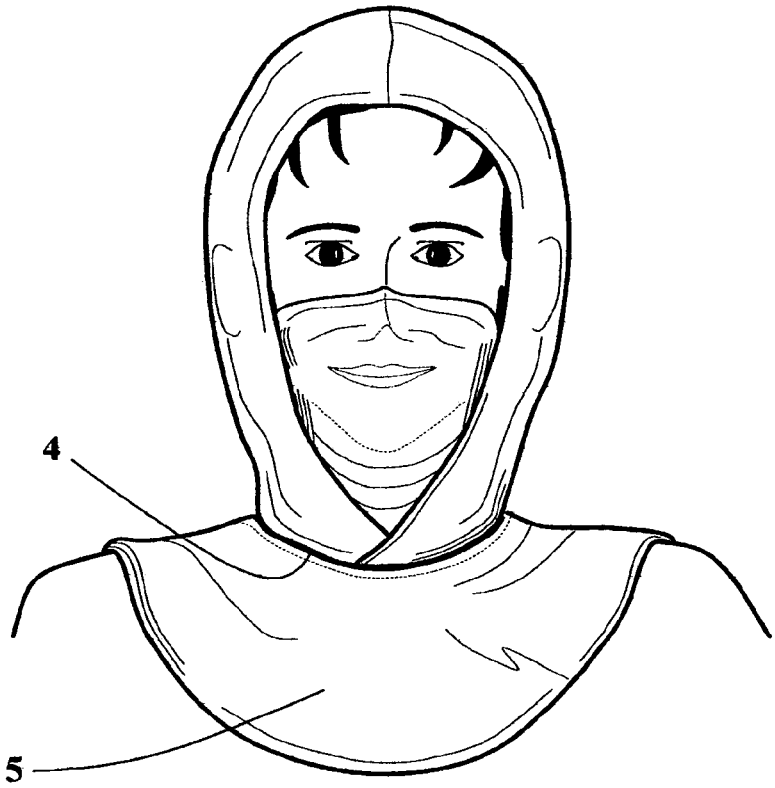
FIG. 2 is a front view of the hooded scarf with a chestpiece.

Instead of a tail, the bottom peripheral end 4 of the neckpiece may be expanded gradually to form a chestpiece 5 as shown in FIG. 2. It can have a triangular shape at the front as shown in FIG. 1E instead of circular. As in the tail, the chestpiece also connects at a bottom peripheral end portion of the neckpiece. The dimensions of and the material for the chestpiece is at the discretion of the wearer or the manufacturer. For inclement weather, the wearer would want the chestpiece to extend to the entire upper chest and back to cover any gap between the hooded scarf 100 and the clothing. The chestpiece can also have a pocket 3 and its incorporation is similar to that described for the tail 2. A secret closable pocket either on the tail or the chestpiece will provide a means for keeping valuables because both can be tucked inside the clothing.

Figure 3:
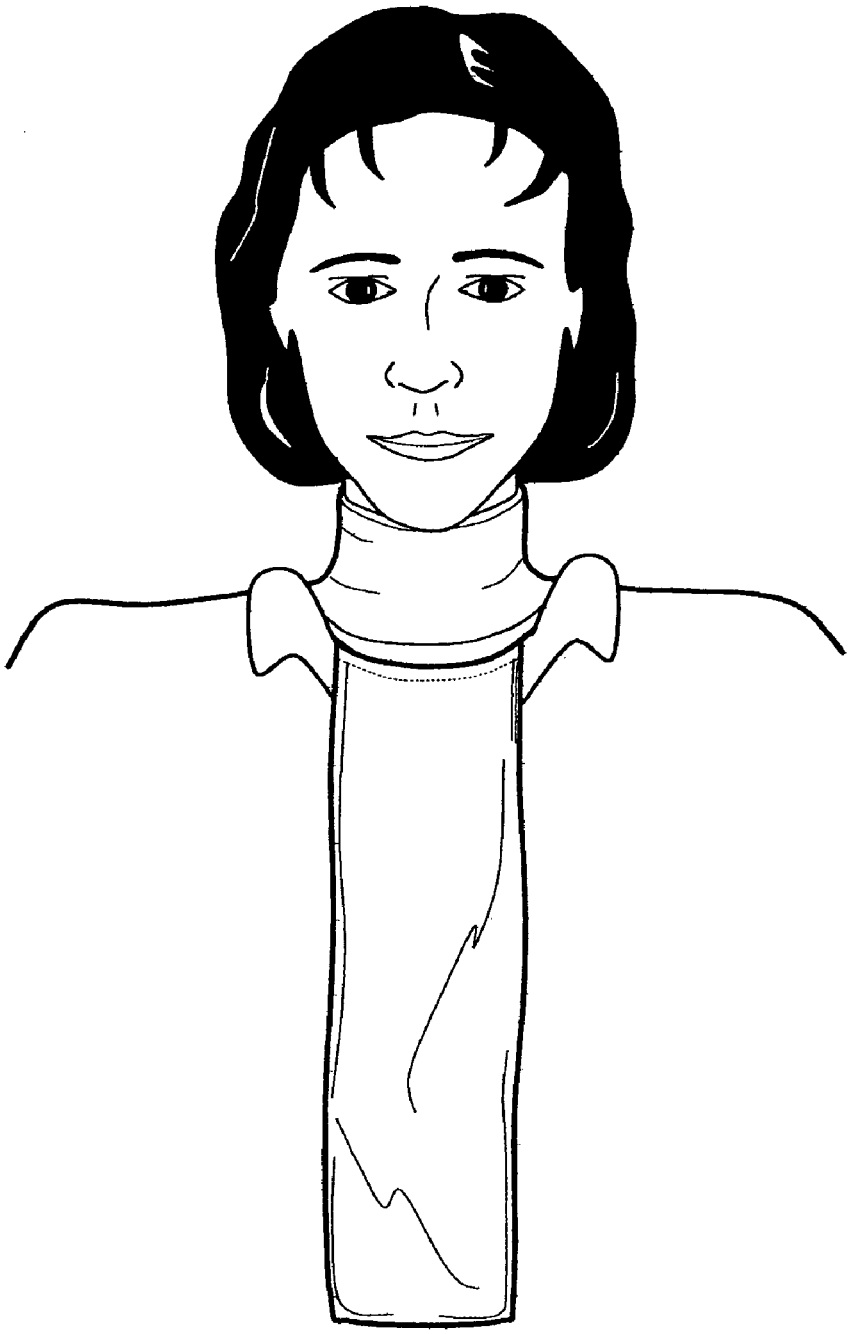
FIG. 3 is a front view of the neckpiece having just enough length to cover the neck.
Figure 3A:
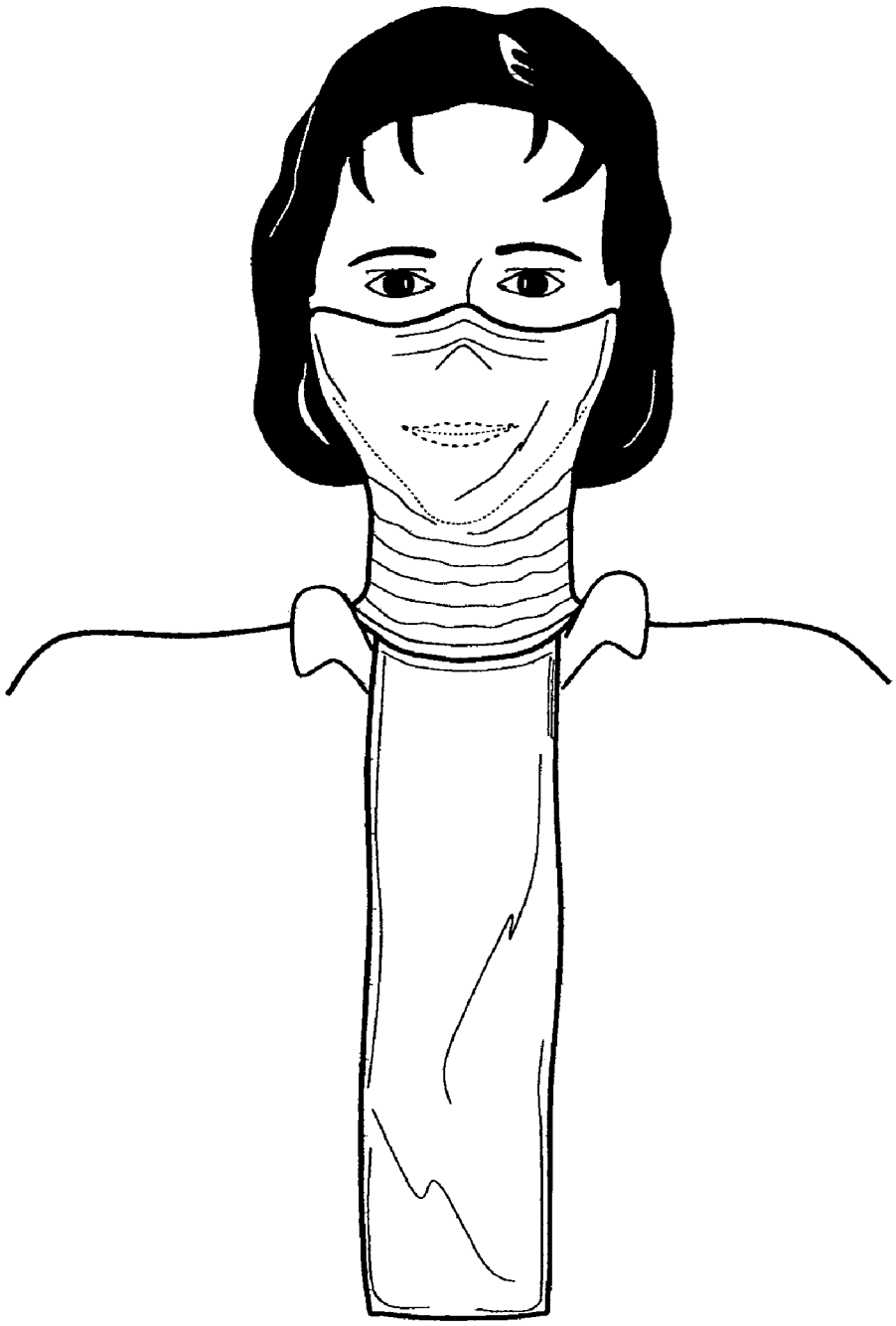
FIG. 3A is a front view of the neckpiece covering the neck, lower face area, ear and nose.
Figure 3B:
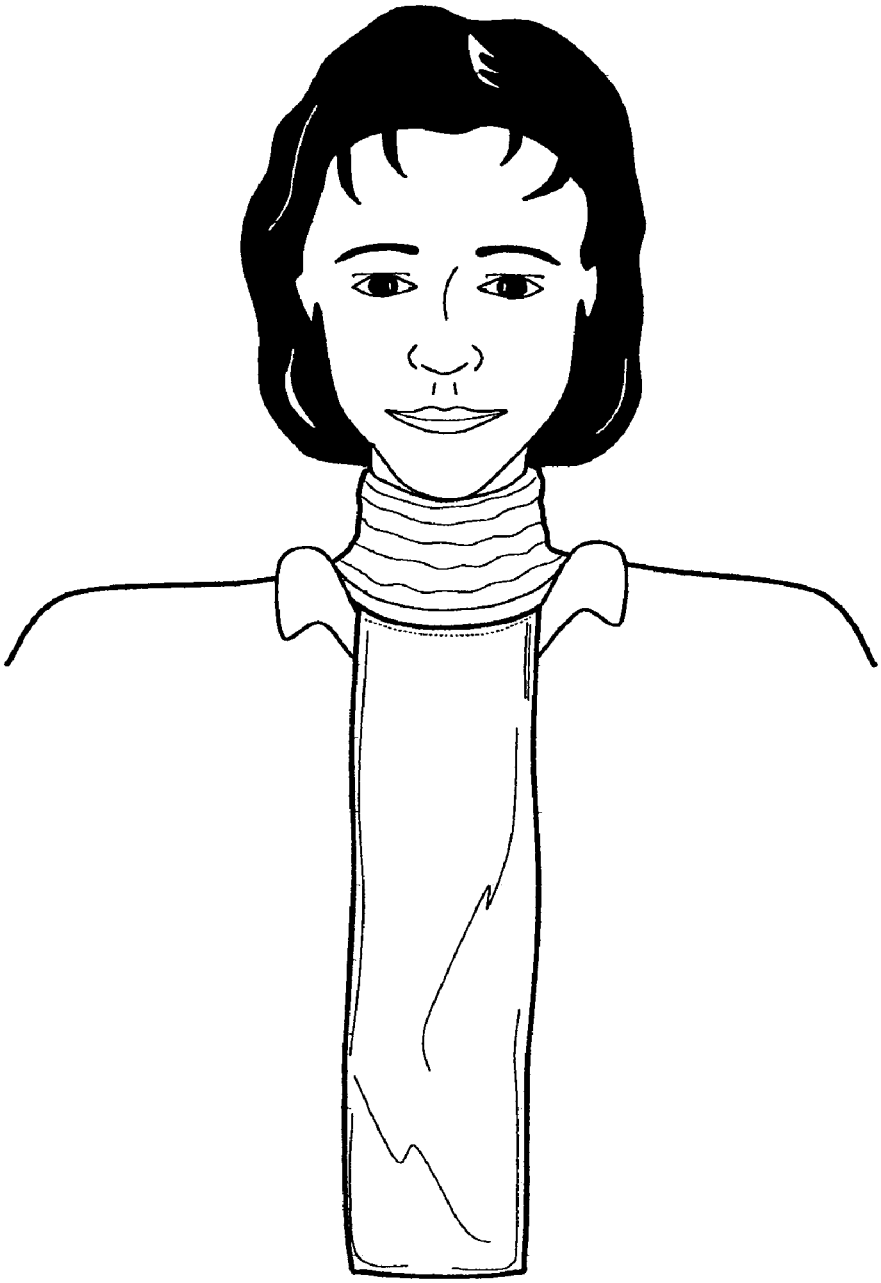
FIG. 3B is a front view of the neckpiece of FIG. 3A as it rests on the neck of a wearer.
Figure 3C:
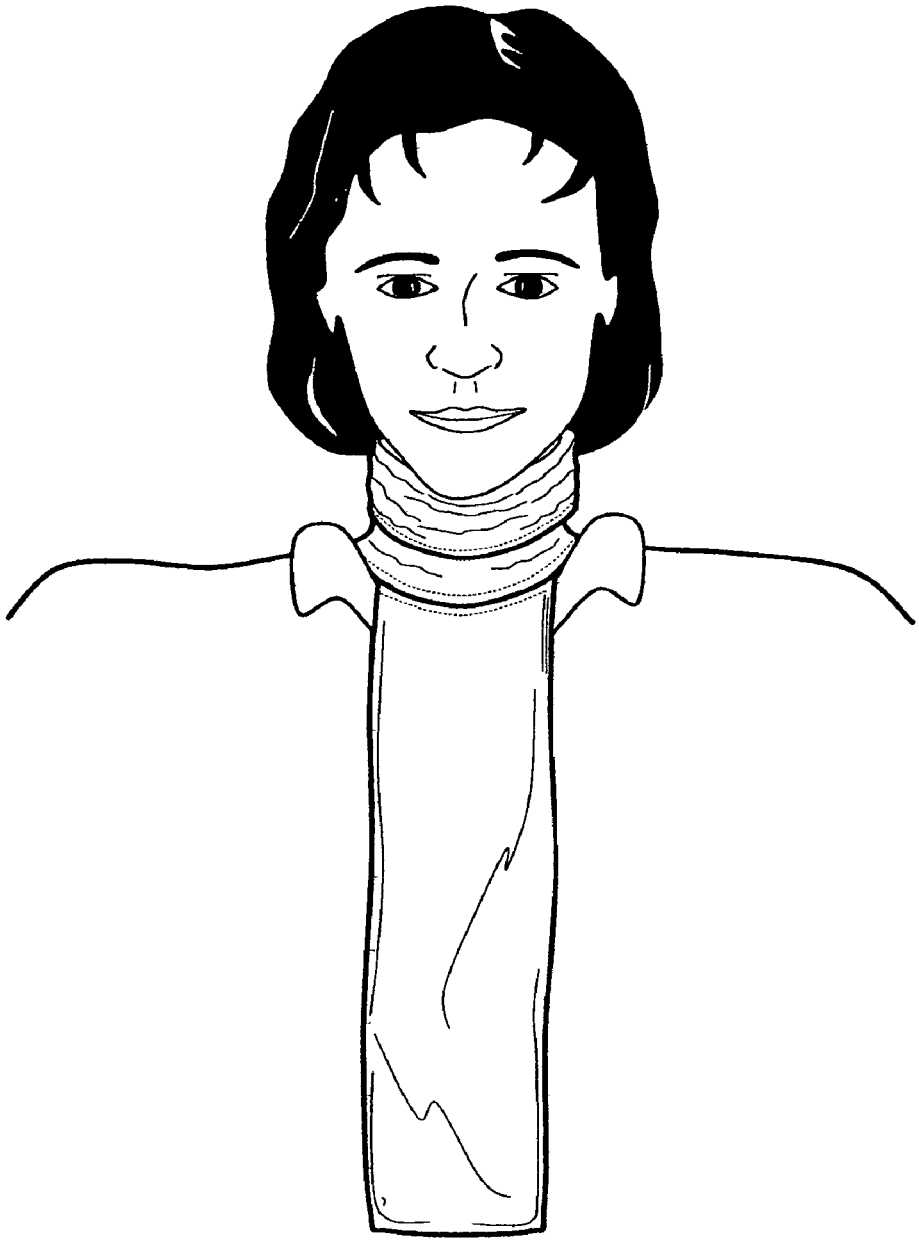
FIG. 3C is a front view of a folded neckpiece on the neck of a wearer.
Figure 3D:
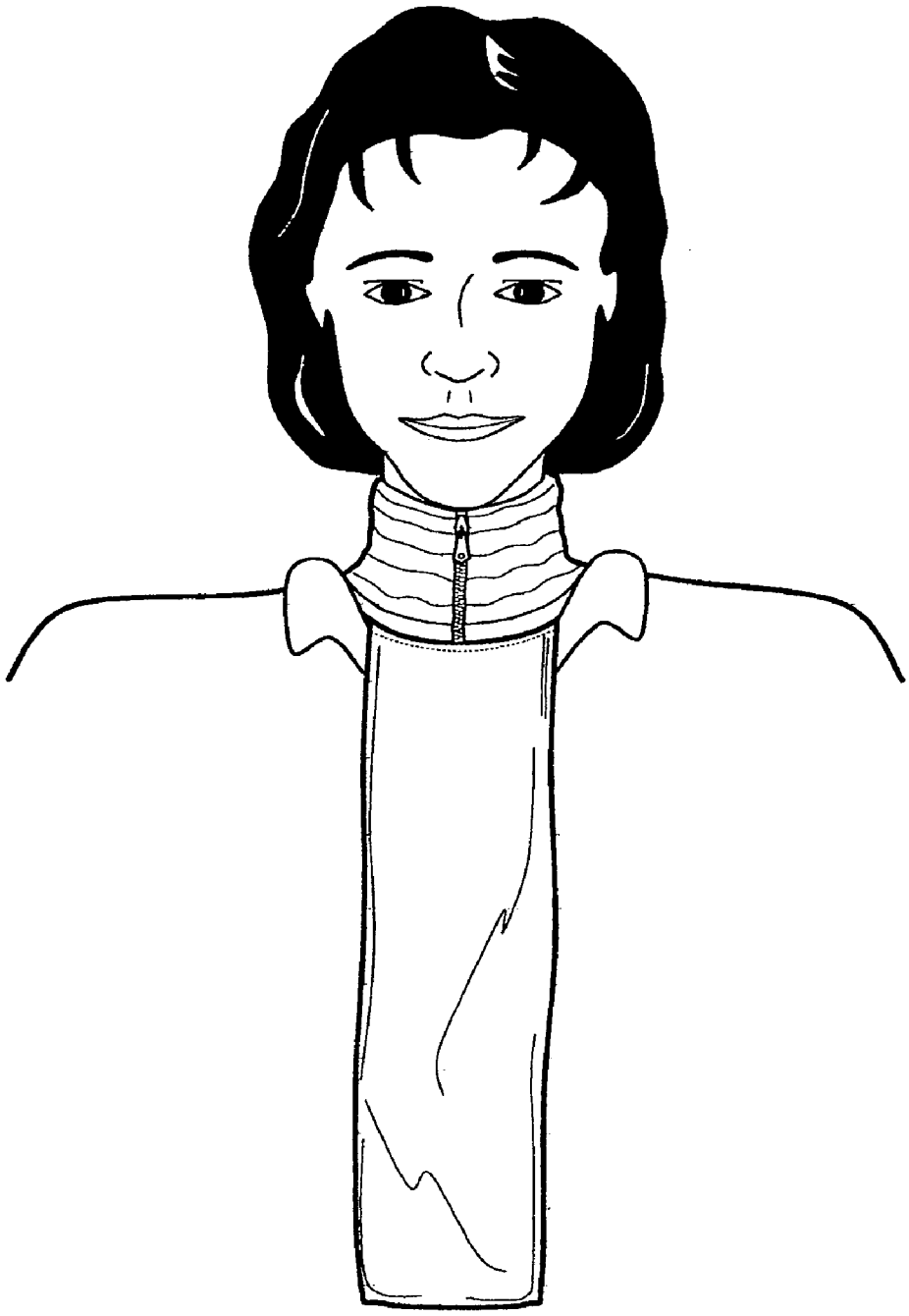
FIG. 3D is a front view of a neckpiece with a zippered opening.
Figure 3E:
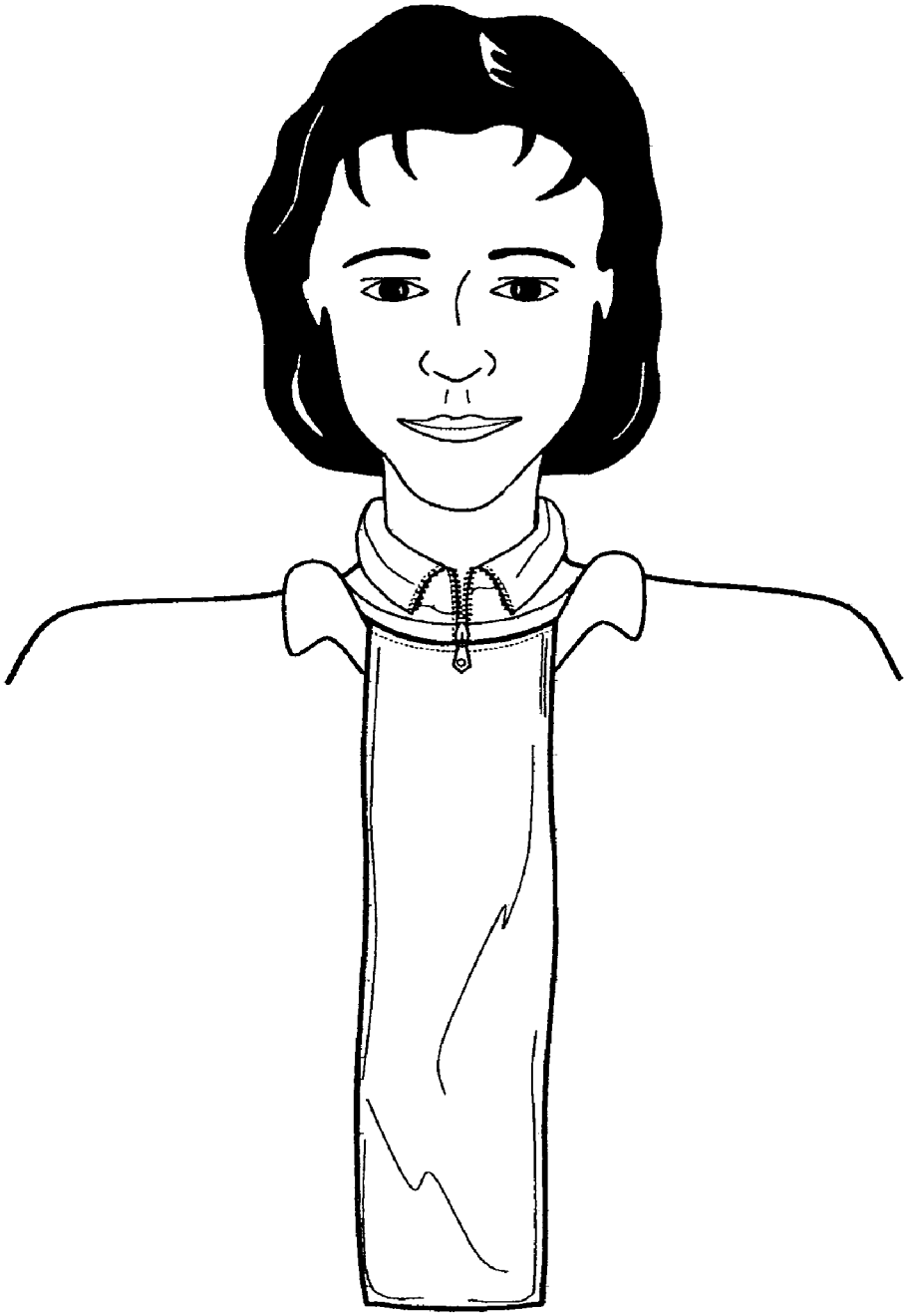
FIG. 3E is a front view of the neckpiece of FIG. 3D opening to a collar.

The opening 6 of the neckpiece 1, obviously will come in different diameters, smaller for children and wider for men and obese wearers. The height of the neckpiece 1 also varies based on the age and gender of the wearer as well as the desired extent of coverage. It is possible, aside from a sizing of petite, small, medium, large and extra large, to produce a one size fits all for each category of wearers, for example, one for children, one for teens, one for women and one for men. The neckpiece can have variable heights. The neckpiece as shown in FIG. 3 has a height just enough to cover the neck. The neckpiece shown in FIG. 3A has a longer height enough to extend contouredly along the upper portion of the cheek bone and over the bridge of the nose to cover the lower face area, ears and nose but leave the eye area open. The wearer can opt to extend or not extend to the face. In the longer tubular neckpiece, when it is desired to cover only the neck, this can be pushed down to wrinkle in the neck area or it can be folded in the same manner as a turtle neck. FIG. 3B shows the neckpiece in a wrinkled manner covering the neck while FIG. 3C shows the neckpiece folded. If one wants a tubular neckpiece that can be opened up to a collar, FIG. 3D shows how a tubular neckpiece can have a closable opening, herein using a zipper for example, opening up to a collar as shown in FIG. 3E. The tubular neckpiece only opens up to form a collar but does not open up all the way because the neckpiece is kept connected with the hood and the tail as shown in FIG. 3E and therefore does not totally open the neckpiece into one having two separate lateral sides. Although the opening is shown in the front, the opening can be on the side or at the back, as well.

Figure 4:
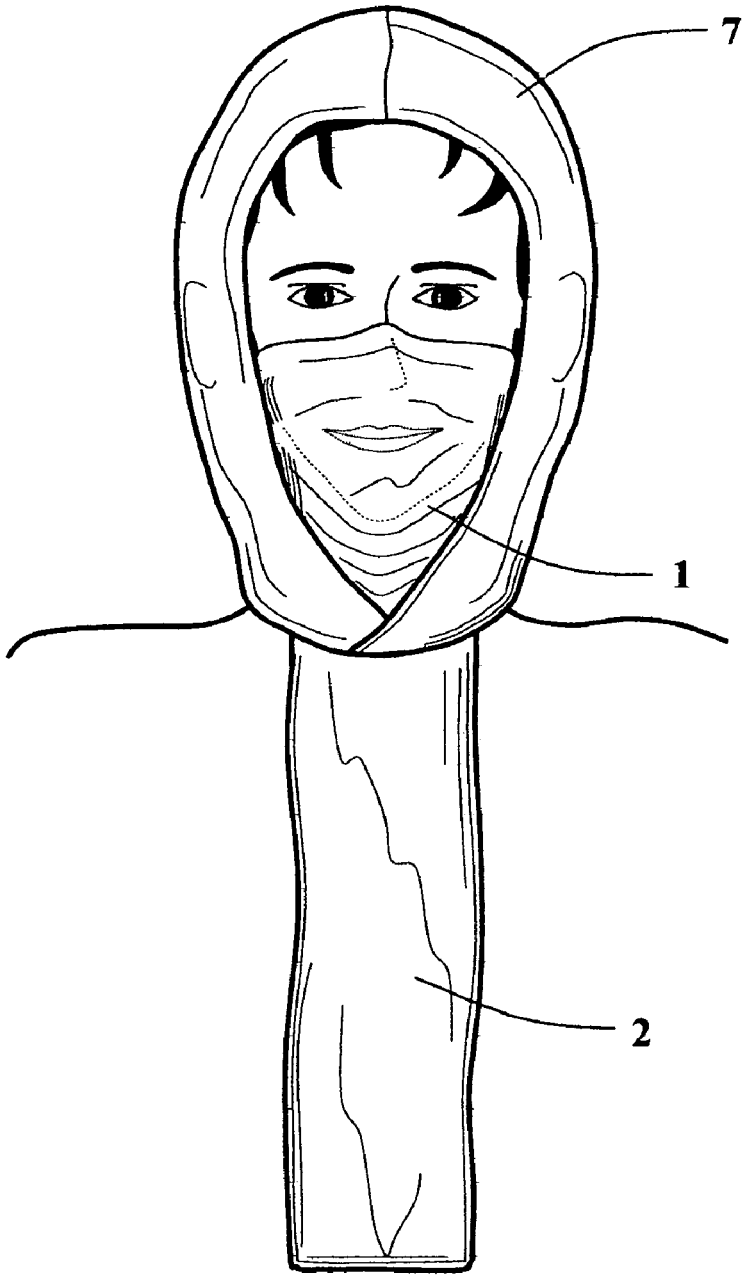
FIG. 4 is a front view of the hooded scarf covering the neck, lower face area, nose and ear having a front tail.

The hood is especially useful during a snowy or windy day. In harsher weather conditions, it is recommended to protect the head and leave behind only the eyes as shown in FIG. 4. The neckpiece and the hood can be knitted, crocheted, woven or sewn as one piece for easy wearing and storage. However, the hood 7 can be detachable. The hood of this invention connects or attach at the bottom peripheral end 4 of the neckpiece to leave the top end 8 of the neckpiece free for entry of the head and additionally to leave it free to expand or retract at will to cover or uncover the lower face area. The degree of tightness of the hood to the wearer's head is at the discretion of the wearer. A drawstring may be incorporated to the hood to control the tightness. The shape and tightness of the hood can vary so long as it can protect the head or in some cases, the hair from being blown or messed up from its desired style.

Figure 5A:
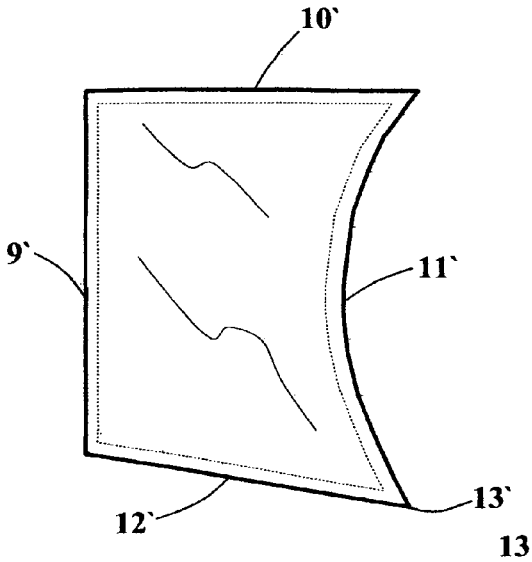
FIG. 5A is a plan view of a piece of material for making a hood having the arcuate side facing right.
Figure 5B:
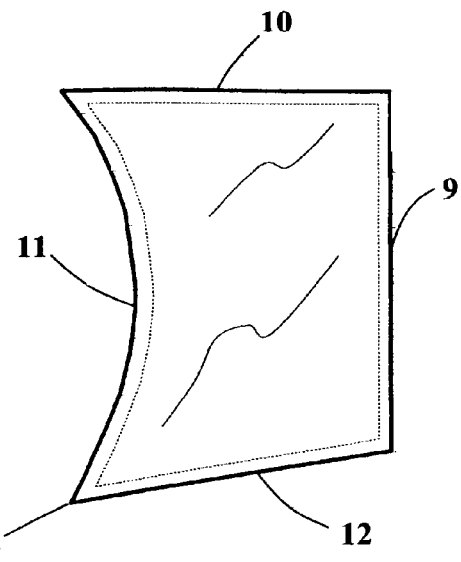
FIG. 5B is a plan view of a piece of material for making a hood having the arcuate side facing left.
Figure 7:
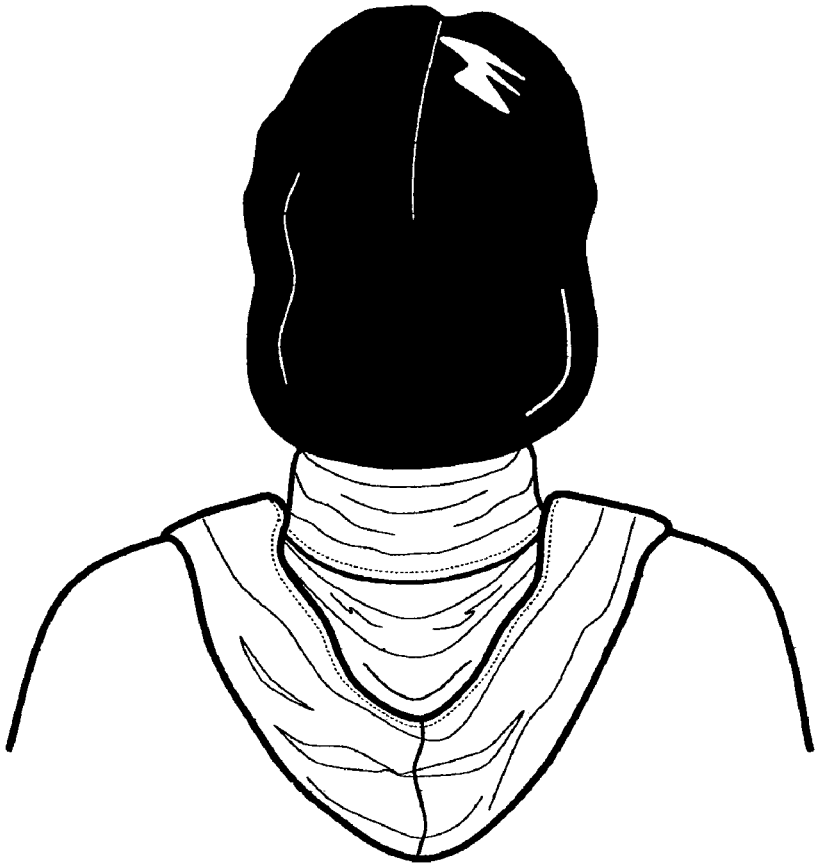
FIG. 7 is a back view of the scarf with the hood hanging at the back of a wearer when not in use.
Figure 8:
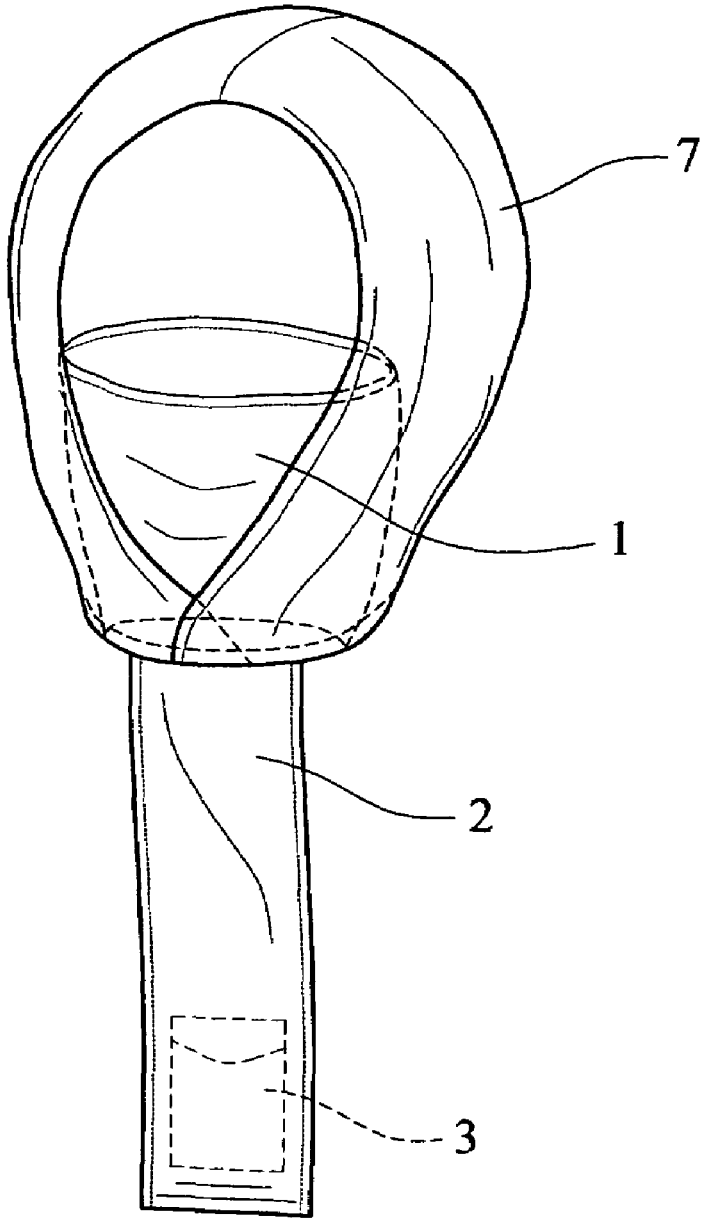
FIG. 8 is a perspective view of the hooded scarf showing a closed pocket on a tail.
Figure 9:
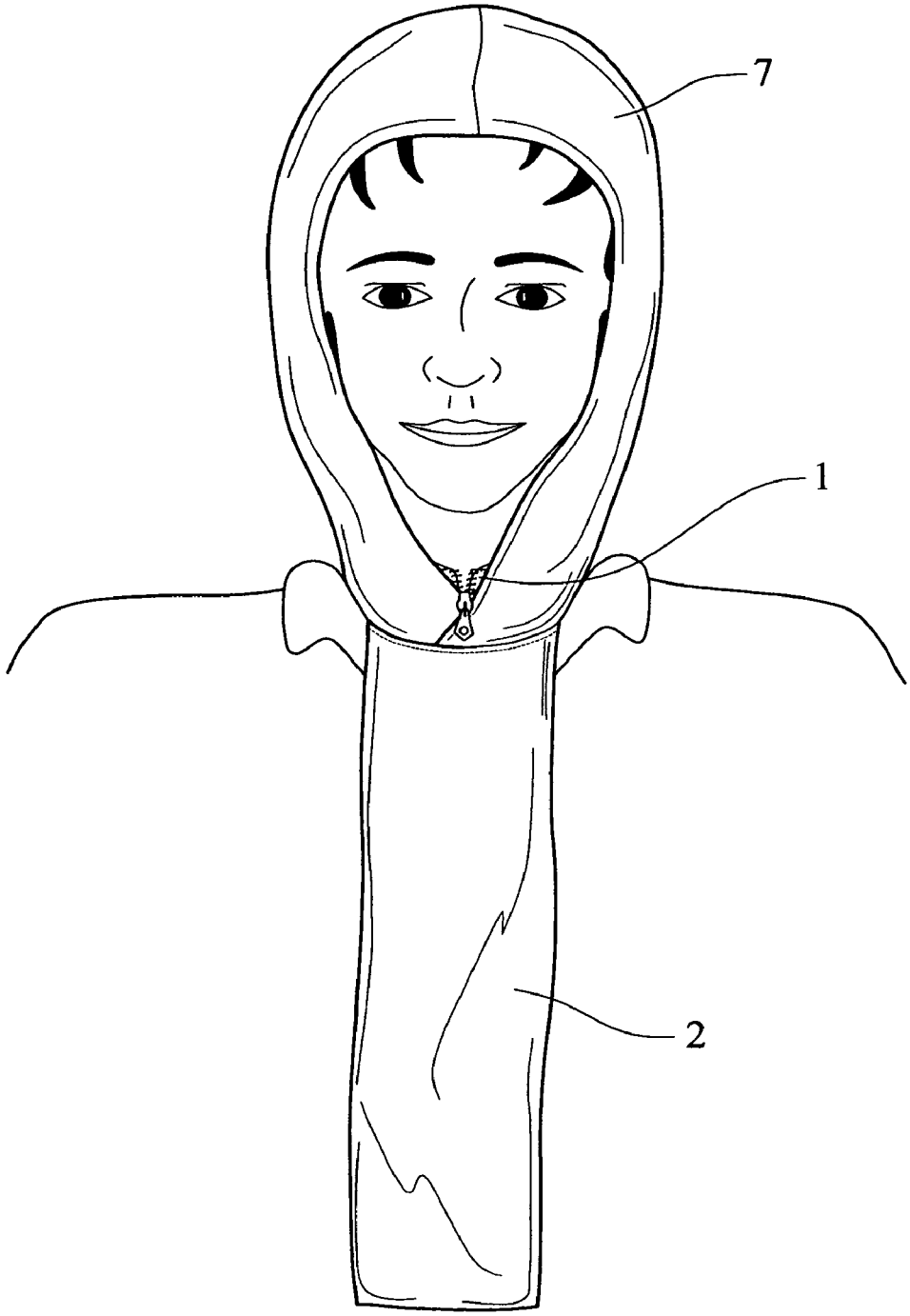
FIG. 9 is a front view of the hooded scarf showing a closable convertible collar or neckpiece.
Figure 10:
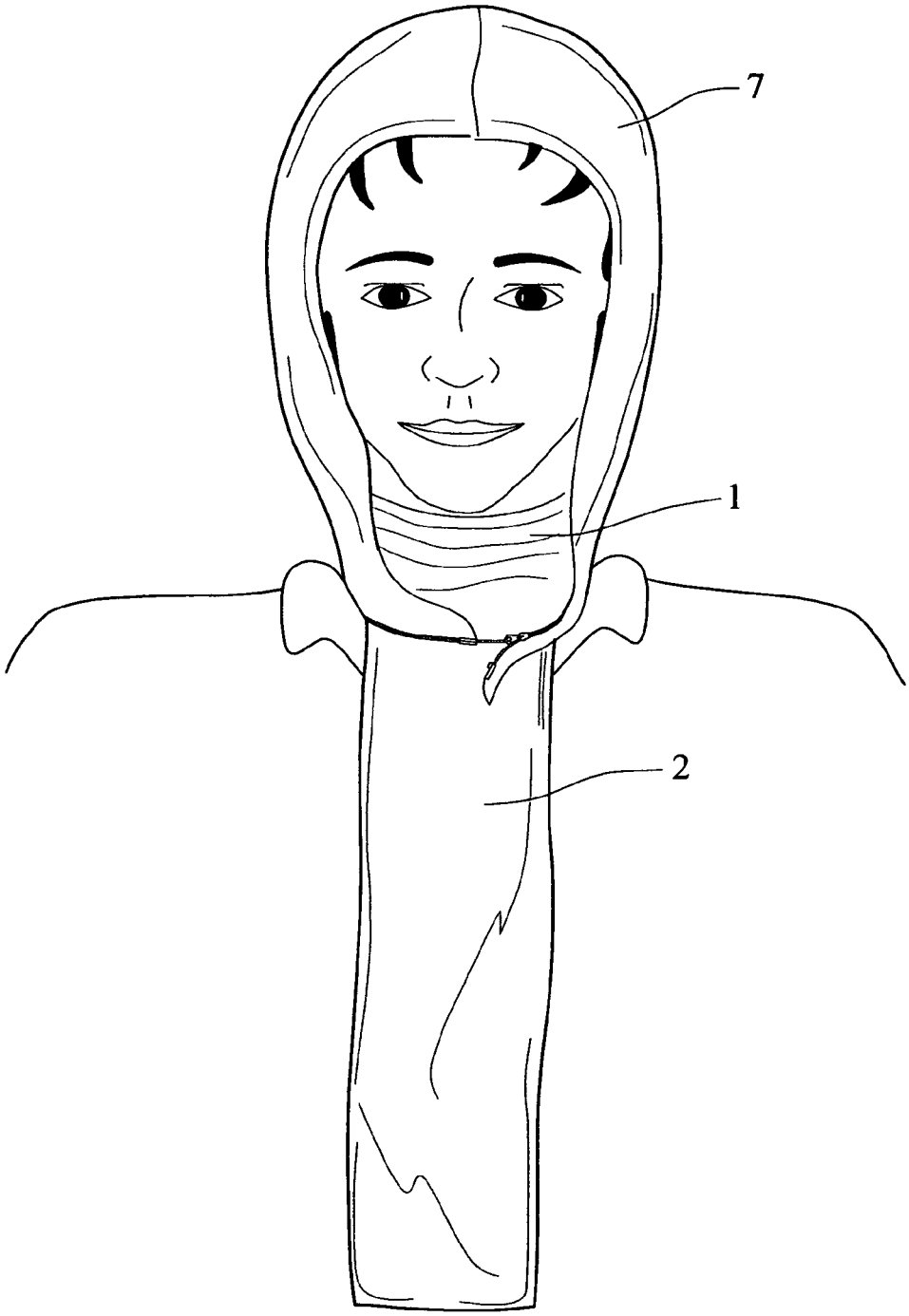
FIG. 10 is a front view of the hooded scarf showing how the hood can detach from the tail and the neckpiece.
Figure 11:
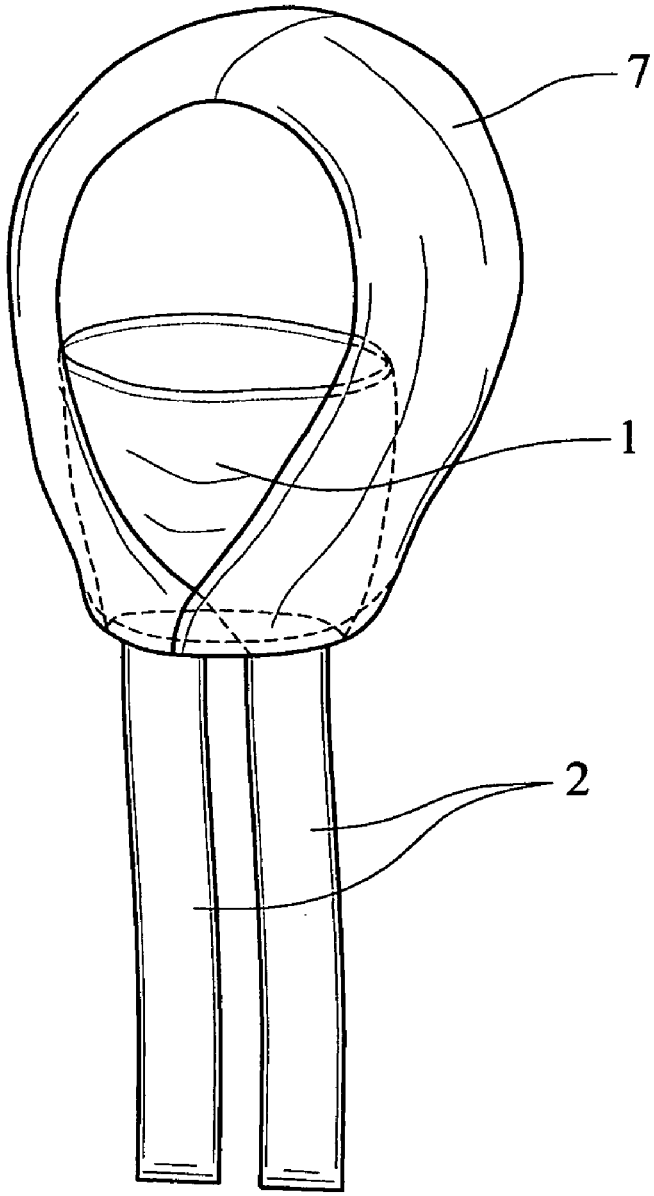
FIG. 11 is a perspective view of the hooded scarf with two tails.

One easy way of attaching a hood 7 at the bottom peripheral end 4 of the neckpiece, for example, is to take two paired pieces of materials shaped as shown in FIGS. 5A and 5B; connect the lateral sides 9 and 9', the top longitudinal sides 10, 10' of the paired pieces of material together, leaving the arcuate ends, 11, 11' free; and, attach the bottom horizontal sides 12, 12' to the bottom peripheral end 4 of the neckpiece with the tip end 13 of one piece recommended to overlap 14 with the tip end 13' of the other piece to form the hood 7 as shown in FIG. 6. After the method of connection stated above, as shown in FIGS. 6 and 7, the hood situates outside of the neckpiece, allowing free movement of the hood into and out of the head of a wearer without affecting the neckpiece as shown in FIGS. 1A, 2, 4, 6 and 7.

The hood as stated, can be detachable. In this case, the horizontal sides 12, 12' are not permanently attached or connected to the bottom peripheral end 4 of the neckpiece but are attached by detachable connector means such as zipper, hook and loop, button arrangements, hook and eye, etc. which allow the hood to be detached when not desired or needed. However, it is recommended especially for children to have the hood permanently attached. The neckpiece and the hood can be knitted woven or crocheted together as a single piece or the hood can be knitted, crocheted, sewn or hemmed at the bottom peripheral end 4 of the neckpiece. This permanent attachment will prevent the children, especially, from removing the hood, losing the hood, as well as prevent bruises that can result from the fasteners, depending upon its kind, as the fasteners traverse the head and neck area. The child no longer needs to ensure that the hooded scarf stays after it is worn. The hood, when not in use, can be simply allowed to hang at the back as shown in FIG. 7.

The hooded scarf caters well to young children because it will not fall off even with extensive body movement such as playing, running, jumping, etc. With conventional scarves, there is always the chance for the scarf to fall off, consequently unprotecting the child when it is needed and it can also be easily lost or misplaced. Tying the ends of conventional scarves do not work well with children. They are easily tempted to immediately untie the knot as soon as the scarf gets into their way.

To use the above hooded scarf, one puts the head opening 6 over the head of the user and pulls the tubular neckpiece 1 downwards through the head until the neckpiece elastically retract and closely fit around the neck. The hood is kept out of the way while the neckpiece is introduced.

To be able to wear the hooded scarf by pulling the tubular neckpiece 1 through the head as well as substantially surround the head, neck and chest of the wearer, the material from which the neckpiece is made must have some elasticity to enable it to stretch and retract to fit the neck, head or chest as desired. The material may be lightweight and/or thin for warm weather use or thick and warmth for cold weather use. The neckpiece made, that is crocheted, woven or knitted from yarn is specially suitable because the yarn is elastically deformable in two axes, i.e. biaxial, such as the x and y axis in a typical two dimensional xy coordinate, and it can stretch and unstretch. When the neckpiece is made from knitted, crocheted or loosely woven yarn, this will automatically produce the openings or channels for breathing as desired and stated above. With this, there is no need to fabricate a special breathing nosepiece or faceguard. Examples of materials, thread or yarn from which the neckpiece can be made or woven are synthetic materials such as acrylic, nylon, polyester, rayon, satin, natural materials such as cashmere, wool, cotton, silk, and combinations of these. Any clothing material can be used so long as it possesses the biaxial elasticity especially for the neckpiece because the neckpiece should be able to expand and retract back and the hood, neckpiece and chestpiece should be able to snug fit as desired to keep these pieces at their desired places. However, the openings between the material should not be too large so as to defeat the purpose of being a protective covering. In fact, the hood 7 can have the same but is recommended to have a tighter knit than the neckpiece and it can also be made of a material different from the neckpiece depending upon its intended usage. Further, as to the kind of synthetic or natural materials to use, this would depend on its intended usage. The water absorption properties of the materials play a major role, for example, nylon is a good material for the hooded scarf used on a snowy or rainy day due to its low water absorption property.

The method of attaching the parts of the hooded scarf and the means to hem or prevent the edges from frilling are widely known and need not be described here.

While the embodiments of the present invention have been described, it should be understood that various changes, adaptations, and modifications may be made therein without departing from the spirit of the invention and the scope of the claims.

I claim:

1. A one-piece hooded scarf, unattached to any garment, comprising:

a tubular neckpiece of variable height having a top end and a bottom peripheral end, not formed by connecting two lateral ends of an elongated rectangular strip, the neckpiece hugging and conforming with the shape of the neck having openings or channels for breathing produced from a woven, knitted or crocheted material elastically deformable in two axes;

a hood connected at the bottom peripheral end of the neckpiece at a position placing the hood outside of the neckpiece allowing free movement of the hood into and out of the head without affecting the neckpiece, and leaving the top end of the neckpiece open thereby allowing free introduction of the neckpiece by pulling the tubular neckpiece over the head of a wearer; and, a longitudinally directed tail extending from the bottom peripheral end of the neckpiece, the tail having a length of at least approximately twice the length of the neckpiece when the neckpiece is fully extended.

2. The scarf of claim 1 wherein the material is a synthetic or natural material.

3. The scarf of claim 1 wherein the material of the hood is the same as the neckpiece.

4. The scarf of claim 1 wherein the material of the hood is different from the neckpiece.

5. The scarf of claim 1 further comprising designs on the tail.

6. The scarf of claim 1 further comprising a closable or open pocket on the tail.

7. The scarf of claim 1 wherein the neckpiece covers or uncovers a lower face area, ear and nose of a wearer.

8. The scarf of claim 1 wherein the neckpiece is of a height just enough to cover the neck of a wearer.

9. The scarf of claim 1 wherein the neckpiece is convertible into a closable collar, the collar forming without disconnecting the bottom peripheral end of the neckpiece from the hood and the tail.

10. The scarf of claim 1 wherein the hood is detachable from or permanently attached to the neckpiece.

11. A one-piece hooded scarf, unattached to any garment, comprising:

a tubular neckpiece of variable height having a top end and a bottom peripheral end, not formed by connecting two lateral ends of an elongated rectangular strip, the neckpiece hugging and conforming with the shape of the neck having openings or channels for breathing produced from a woven, knitted or crocheted material elastically deformable in two axes;

a hood connected at the bottom peripheral end of the neckpiece at a position placing the hood outside of the neckpiece allowing free movement of the hood into and out of the head without affecting the neckpiece, and leaving the top end of the neckpiece open thereby allowing free introduction of the neckpiece by pulling the tubular neckpiece over the head of a wearer; and, a chestpiece extending or connecting from the bottom peripheral end of the neckpiece, the chestpiece covering the entire upper chest of a wearer.

12. The scarf of claim 11 further comprising designs on the chestpiece.

13. The scarf of claim 11 further comprising a closable or open pocket on the chestpiece.

14. The scarf of claim 11 wherein the hood is detachable from or permanently attached to the neckpiece.

15. The scarf of claim 11 wherein the chestpiece cover the entire upper chest and back of the wearer.

16. The scarf of claim 1 further comprising a second tail extending from the bottom peripheral end of the neckpiece.

17. The scarf of claim 1 wherein the neckpiece and the hood are knitted, crocheted, woven and sewn as a single piece.

* * * * *